US007570779B2

(12) United States Patent
Sugiura

(10) Patent No.: US 7,570,779 B2
(45) Date of Patent: Aug. 4, 2009

(54) SPEAKER

(75) Inventor: Hideaki Sugiura, Yamagata-ken (JP)

(73) Assignees: Pioneer Corporation, Tokyo (JP); Tohoko Pioneer Corporation, Yamagata-ken (JP)

( * ) Notice: Subject to any disclaimer, the term of this patent is extended or adjusted under 35 U.S.C. 154(b) by 613 days.

(21) Appl. No.: 11/085,180

(22) Filed: Mar. 22, 2005

(65) Prior Publication Data

US 2005/0226458 A1 Oct. 13, 2005

(30) Foreign Application Priority Data

Mar. 23, 2004 (JP) ..... 2004-085061

(51) Int. Cl.
*H04R 25/00* (2006.01)

(52) U.S. Cl. ..... 381/412; 381/396; 381/397; 381/433

(58) Field of Classification Search ..... 381/396, 381/412, 419, 420, 433, 182, 421, 401, 336, 381/332, 348, 353, 354, 403, 424, 397
See application file for complete search history.

(56) References Cited

U.S. PATENT DOCUMENTS

| | | | | |
|---|---|---|---|---|
| 5,243,151 | A * | 9/1993 | Prokisch | 181/171 |
| 5,295,195 | A * | 3/1994 | Mitobe et al. | 381/433 |
| 5,583,945 | A * | 12/1996 | Iijima et al. | 381/412 |
| 6,537,234 | B1 | 3/2003 | Komatsu | |
| 2005/0276438 | A1 * | 12/2005 | Kobayashi et al. | 381/433 |

FOREIGN PATENT DOCUMENTS

| | | | |
|---|---|---|---|
| DE | 93 01 425 | U1 | 5/1993 |
| GB | 801 695 | A | 9/1958 |
| JP | 10-117472 | A | 5/1998 |
| JP | 2005-057640 | | 3/2005 |

* cited by examiner

*Primary Examiner*—Suhan Ni
*Assistant Examiner*—Jasmine Pritchard
(74) *Attorney, Agent, or Firm*—Arent Fox LLP

(57) ABSTRACT

In a speaker having a magnet circuit causing vibrations of a diaphragm and attached to and supported on a frame, a plurality of projections is formed on a bottom portion of the frame supporting the magnetic circuit. The projections are in point contact with a rear-facing face of a flange of a yoke partially forming the magnetic circuit in order for the magnetic circuit to be supported on the speaker frame.

6 Claims, 4 Drawing Sheets

SPEAKER

BACKGROUND OF THE INVENTION

1. Field of the Invention

This invention relates to a structure of speakers.

The present application claims priority from Japanese Application No. 2004-85061, the disclosure of which is incorporated herein by reference.

2. Description of the Related Art

FIG. 1 is a sectional view illustrating the structure of a conventional speaker.

In FIG. 1, a damper 2 is interposed between a frame 1 and a voice coil bobbin 4. The voice coil bobbin 4 is coupled to a diaphragm 3 and supported by the damper 2 in such a manner as to permit it to vibrate in the axis direction. A portion of the voice coil bobbin 4 around which a voice coil 5 is wound is inserted into a magnetic gap between a yoke 8 and a plate 6 and magnet 7 which form a magnetic circuit. The magnetic circuit gives rise to the vibrations of the voice coil bobbin 4 and the diaphragm 3 in the axis direction.

The conventional speaker has the yoke 8 coupled to a part of the bottom portion of the frame 1 in order to support the magnetic circuit.

However, the speaker of the structure as described above may possibly produce dissonance because when the speaker is driven, the magnetic circuit reacts to the vibrations of the voice coil bobbin 4 and the diaphragm 3, whereupon the vibration is transmitted from the yoke 8 to the frame 1, and then from the frame 1 to portion of the speaker-mounted structure.

SUMMARY OF THE INVENTION

An object of the present invention is to solve the problem associated with the conventional speakers as described above.

To achieve this object, the present invention provides a speaker having a magnetic circuit causing vibrations of a diaphragm and attached to and supported on a speaker frame, which is characterized by comprising a plurality of projections that are formed on a portion of the speaker frame supporting the magnetic circuit and are in contact with a component partially forming the magnetic circuit in order for the magnetic circuit to be supported on the speaker frame.

In the best mode for carrying out the present invention, the speaker comprises a magnetic circuit that is constituted of a yoke, a magnet and a plate and supported in a predetermined position in the frame by point contact between the rear face of the yoke and the plurality of projections formed on the inner face of the bottom portion of the frame that supports the diaphragm.

In the speaker in the best mode, a plurality of projections is formed on the inner face of the bottom portion of the frame, and in point contact with the rear face of the yoke to thereby support the magnetic circuit. As compared with the conventional speakers, this effects a reduction in the vibrations transmitted from the yoke to the frame due to the reaction of the magnetic circuit to the vibrations of the diaphragm when the speaker is driven. In this way the problem associated with conventional speakers of dissonance being produced by transmission of the vibrations from the frame to a portion of the speaker-mounted structure is solved.

These and other objects and features of the present invention will become more apparent from the following detailed description with reference to the accompanying drawings.

DETAILED DESCRIPTION OF THE PREFERRED EMBODIMENT

Figure 1:
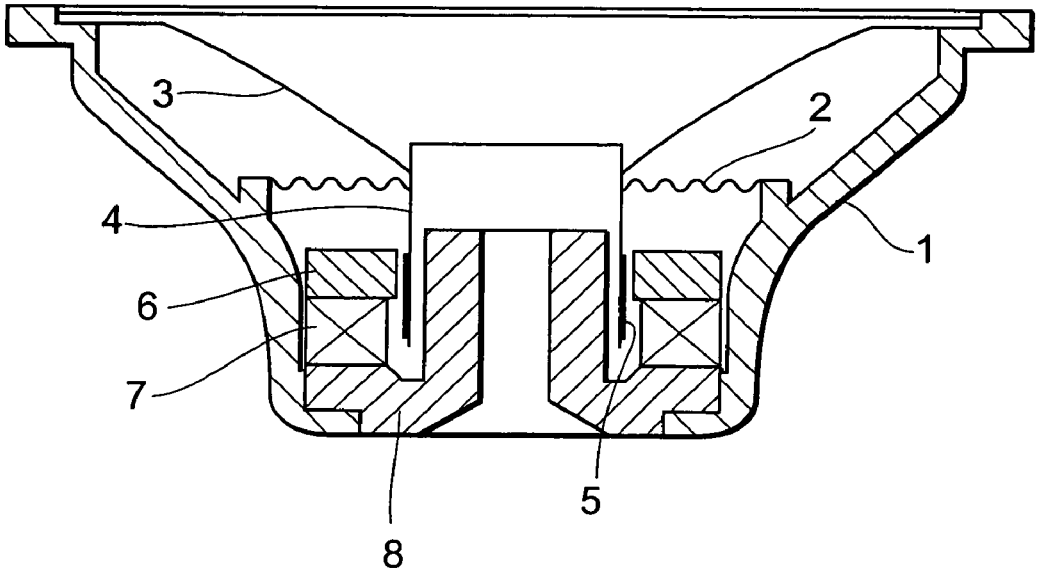
Fig.1 RELATED ART
FIG. 1 is a side sectional view illustrating the structure of a conventional speaker.
Figure 2:
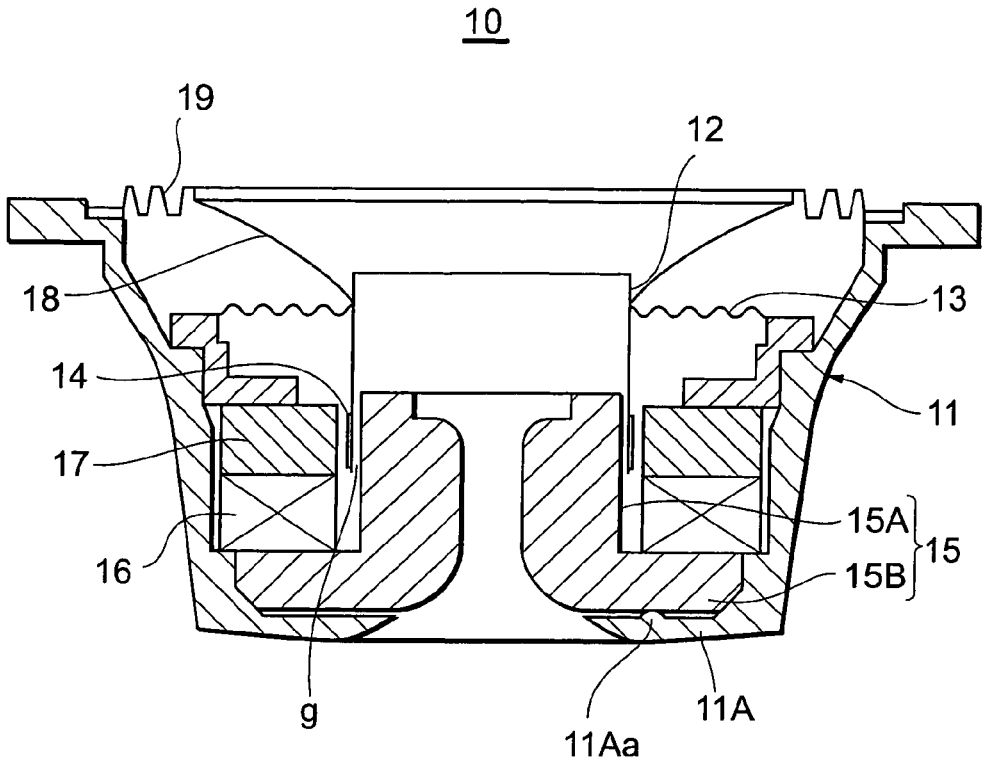
FIG. 2 is a side sectional view illustrating an embodiment according to the present invention.

FIG. 2 illustrates an embodiment of a speaker according to the present invention.

In FIG. 2, a speaker 10 has a damper 13 interposed between a frame 11 and a voice coil bobbin 12. The damper 13 supports the voice coil bobbin 12 in such a way as to permit the voice coil bobbin 12 to vibrate in the axis direction. A voice coil 14 is wound around the outer periphery of a rear portion (a lower portion in FIG. 2) of the voice coil bobbin 12.

A magnetic circuit of the speaker 10 is constituted of a yoke 15, a ring-shaped magnet 16 and a ring-shaped plate 17. The yoke 15 has a flange 15B formed integrally on the outer periphery of a rear end (a lower end in FIG. 2) of a cylinder 15A. The magnet 16 is supported on the flange 15B while its central portion is fitted around the cylinder 15A of the yoke 15 in a manner as described later. The plate 17 is securely positioned on the magnet 16 while its central portion is similarly fitted around the cylinder 15A of the yoke 15.

A magnetic gap g of a required width is formed between the outer periphery of the cylinder 15A of the yoke 15 and the inner periphery of the plate 17. A portion of the voice coil bobbin 12 around which the voice coil 14 is wound is inserted into the magnetic gap g. Thus when current passes through the voice coil 14, the magnetic circuit causes vibration of the voice coil bobbin 12 in the axis direction (the up-down direction in FIG. 2).

A diaphragm 18 is coupled to a portion of the voice coil bobbin 12 which is positioned closer to the leading end (the upper end in FIG. 2) of the voice coil bobbin 12 than the portion to which the damper 13 is coupled is positioned. The outer periphery portion of the diaphragm 18 is supported, via an edge 19, by the outer periphery portion of the frame 11 in such a manner as to permit the diaphragm 18 to vibrate.

The following is a detailed description of the structure of part of the frame 11 supporting the magnetic circuit.

Figure 3:
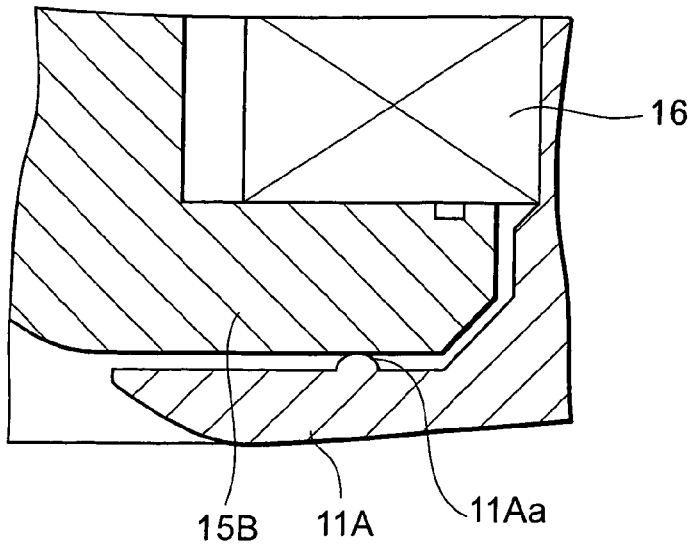
FIG. 3 is an enlarged view of essential part of the embodiment.
Figure 4:
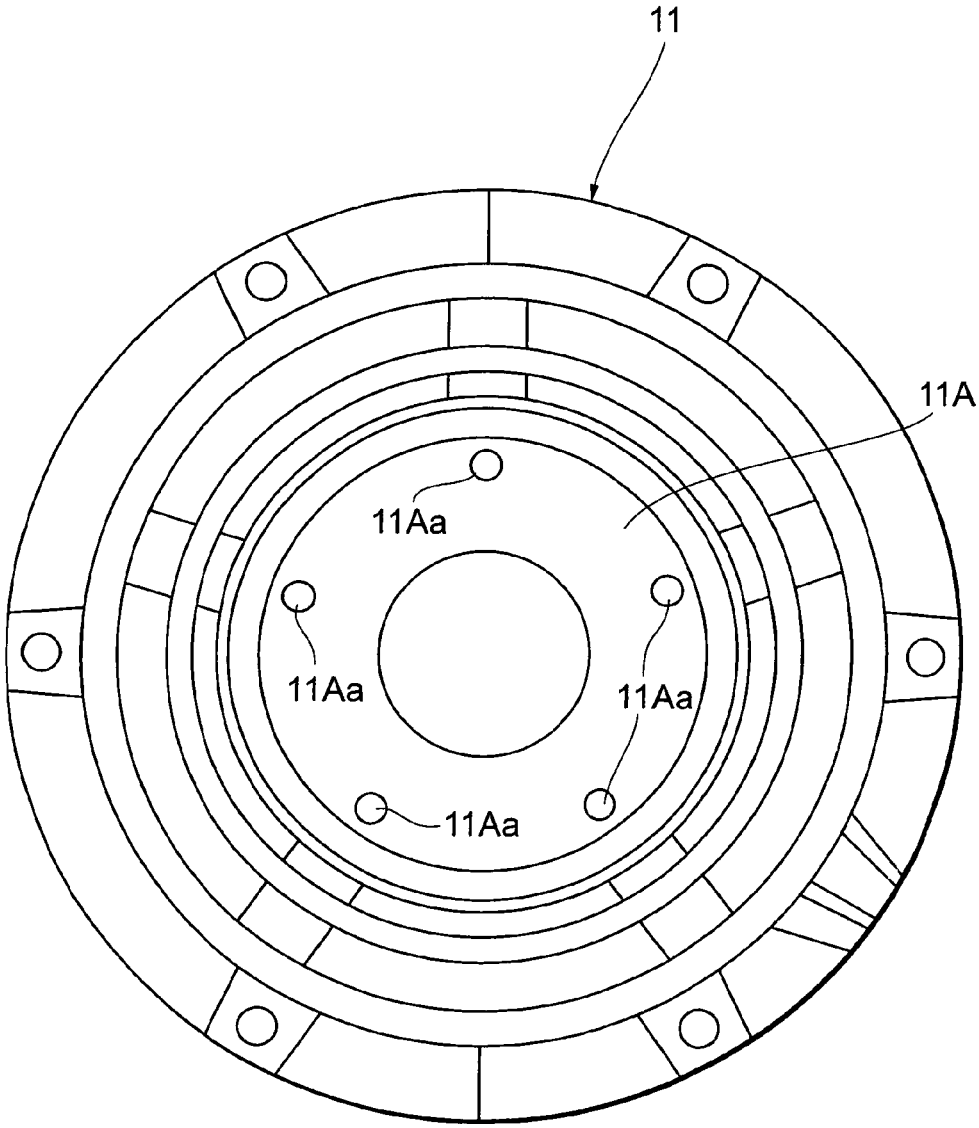
FIG. 4 is a plane view of a frame in the embodiment.

FIG. 3 is an enlarged view of the part of the frame 11 supporting the magnetic circuit. FIG. 4 is a plan view of the frame 11.

As illustrated in FIGS. 3 and 4, a plurality of projections 11Aa (five projections 11Aa in the example shown in FIG. 4) are formed on the front-side face of a bottom portion 11A of the frame 11 which supports the magnetic circuit.

The projections 11Aa are placed in contact with the rear-side face (the lower face in FIGS. 2 and 3) of the flange 15B of the yoke 15. In this way the magnetic circuit is supported on the frame 11.

Figure 5:
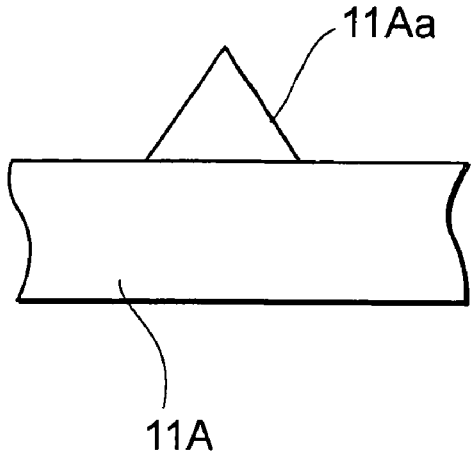
FIG. 5 is a sectional view showing an example of a shape of a projection in the embodiment.
Figure 6:
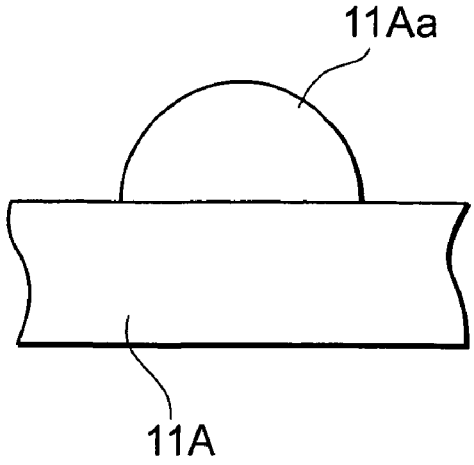
FIG. 6 is a sectional view showing another example of a shape of a projection in the embodiment.

The projections 11Aa can be formed in various shapes, such as a circular cone shape as shown in FIG. 5 or a hemispherical shape as shown in FIG. 6. Whatever the case, the projection 11Aa is shaped so that the leading end comes into point contact at with the flange 15B of the yoke 15.

The projections 11Aa are projected inward (upward in FIG. 3) through the inner surface of the bottom portion 11A of the frame 11.

In this case, when the frame 11 is formed of a metal-made plate material, a pressing process can be used to form the projections 11Aa.

As described hitherto, in the foregoing speaker the magnetic circuit is supported on the frame 11 by means of point contact with the plurality of projections 11Aa which are formed on the bottom portion 11A of the frame 11. As compared with the conventional speakers, this effects a reduction in the vibration transmitted from the yoke 15 to the frame 11 by the reaction of the magnetic circuit to the vibrations of the voice coil bobbin 12 and the diaphragm 18 when the speaker is driven.

Thus, the conventional problem of dissonance being produced by transmission of the vibration from the frame 11 to the portion of the speaker-mounted structure is solved.

Further, the structure for preventing transmission of the vibration from the magnetic circuit to the frame 11 as described above is achieved merely through the process of forming the frame 11 without an increase in the number of components in the conventional speaker. Consequently, no increase in the manufacturing costs of the products is possible.

The terms and description used herein are set forth by way of illustration only and are not meant as limitations. Those skilled in the art will recognize that numerous variations are possible within the spirit and scope of the invention as defined in the following claims.

What is claimed is:

1. A speaker having a magnetic circuit causing vibrations of a diaphragm and attached to and supported on a speaker frame, the magnet circuit being constituted of a yoke, a magnet and a plate, the speaker comprising, a plurality of projections formed on a front-facing face of a bottom portion of the speaker frame supporting the magnetic circuit, and being in contact with a rear-facing face of the yoke in order for the magnetic circuit to be supported on the speaker frame a space being formed between the rear-facing face of the yoke and the front-facing face of the bottom portion of the speaker frame.

2. The speaker according to claim 1, wherein the projections are in point contact with the rear-facing face of the yoke.

3. The speaker according to claim 2, wherein each of the projections has a circular cone shape.

4. The speaker according to claim 2, wherein each of the projections has a hemispherical shape. pg,9

5. The speaker according to claim 1, wherein the projections are pressed on the speaker frame.

6. The speaker according to claim 1, wherein a further space is formed between a whole side surface of the yoke and the speaker frame.

* * * * *